United States Patent [19]

Mugford

[11] Patent Number: 4,538,368

[45] Date of Patent: Sep. 3, 1985

[54] CHILD'S OVERSHOE

[76] Inventor: Bernadette Mugford, 2 Lamson Ave., Goffstown, N.H. 03045

[21] Appl. No.: 506,717

[22] Filed: Jun. 22, 1983

[51] Int. Cl.[3] ..... A43B 3/30

[52] U.S. Cl. ..... 36/112; 36/138; 36/7.1 R; 36/58.5

[58] Field of Search ..... 36/97, 99, 102, 112, 36/138, 58.5, 7.1 R, 50, 72 R, 9 R, 7.3; 2/239

[56] References Cited

U.S. PATENT DOCUMENTS

| | | | |
|---|---|---|---|
| 294,020 | 2/1884 | Eisendrath | 36/136 |
| 296,314 | 4/1884 | Carter | 36/7.1 R |
| 1,494,653 | 5/1924 | Walters | 36/7.1 R |
| 1,644,217 | 10/1927 | Breford | 36/7.1 R |
| 2,398,510 | 4/1946 | Wilson | 36/112 X |
| 2,745,196 | 5/1956 | Schneider et al. | 36/112 X |
| 2,756,518 | 7/1956 | Raney | 36/58.5 X |
| 2,901,840 | 9/1959 | Ferguson | 36/7.1 R |
| 3,106,790 | 10/1963 | Zimmon | 36/9 R |
| 4,204,345 | 5/1980 | Bradley | 36/97 |
| 4,302,889 | 12/1981 | Negrin | 36/7.3 |
| 4,376,344 | 3/1983 | Kimsey | 36/50 X |

FOREIGN PATENT DOCUMENTS

| | | | |
|---|---|---|---|
| 70430 | 5/1946 | Norway | 36/10 |

*Primary Examiner*—Werner H. Schroeder
*Assistant Examiner*—T. Graveline
*Attorney, Agent, or Firm*—Wolf, Greenfield & Sacks

[57] ABSTRACT

An overshoe especially suitable for wear by young children is provided. The overshoe comprises a loosely-fitting outer boot of flexible material having a snug-fitting expandable liner. The expandable liner is pulled outside the boot and the wearer's shoe is placed in position in the liner. The shoe is then slipped into the boot, pulling the liner back into place. Ankle straps and a drawstring closure are provided in order to afford a snug fit and to keep the boot in place. The invention allows the parent to place the overshoe on the child's foot with the assurance that the child's shoe is in proper position in the boot. The invention also provides an overshoe which is not likely to slip off the child's foot along with the shoe. One size of the overshoe may be worn over a variety of shoe sizes.

17 Claims, 5 Drawing Figures

CHILD'S OVERSHOE

BACKGROUND OF THE INVENTION

1. Field of the Invention

This invention relates to an overshoe and particularly to an improved design for an overshoe which is especially advantageous for wear by small children.

2. Discussion of the Prior Art

Children's overshoes of the conventional type have presented difficulties both for the child and for the parent. The conventional child's overshoe is often difficult even for the parent to put on over the child's shoe. Even when the child's overshoe appears to be in place, the parent can not easily determine if the shoe is in its proper position in the overshoe. The conventional child's overshoe or boot is also somewhat heavy and has a tendency to slip off the child's foot while the shoe remains in place inside the overshoe. Overshoes are quickly outgrown by young children, since children's overshoes or boots are designed to fit one shoe size. Further disadvantages of conventional children's overshoes include the fact that many types are not very warm, and the problem of the opening of the overshoe allowing snow or water to get inside the overshoe or boot.

SUMMARY OF THE INVENTION

Accordingly, it is an object of the present invention to provide an overshoe especially advantageous for children's wear which is easy to put on the child's foot.

Another object of the invention is to provide a child's overshoe which will not have a tendency to slip off the child's foot.

An additional object of the invention is to provide a child's overshoe that, when taken off the shoe, leaves the shoe intact on the foot.

A further object of the present invention is to provide a child's overshoe wherein one size overshoe will fit a range of sizes of children's shoes.

Still another object of the present invention is to provide a child's overshoe which affords sufficient warmth and protection from the elements to be worn in winter conditions.

Still another object of the invention is to provide a boot that may be worn over a socked foot and still provides sufficient warmth and dryness.

The overshoe of the present invention comprises an outer boot of flexible material shaped to loosely fit over the wearer's shoed foot. An expandable sock-like liner inside the boot stretches to snuggly fit over the wearer's shoe and lower leg. The sock-like liner and the boot are attached to each other only along the perimeters of their top openings, so that the sock-like liner may be pulled inside-out outside the boot. To put the overshoe on, the wearer's shoe is placed in the sock-like liner which has been pulled outside the boot. Once the shoe is in place in the sock-like liner, the shoe is then slipped inside the boot along with the sock-like liner. The overshoe is provided preferably with straps both above and below the ankle portion of the boot in order to provide a snug fit once the boot is in place. The boot is further provided with a drawstring and/or elastic banding around the top opening in order to hold the boot in place and to keep snow and water from getting inside the overshoe. The overshoe is also provided with an additional liner between the sock-like lining and the outer boot, so as to provide additional warmth and shape to the overshoe. The soles of the overshoe are of any light-weight material which provides sufficient friction and dryness for the wearer in inclement weather conditions.

The overshoe of the present invention is especially suitable for wear by children, since the sock-like liner provides a means for the parent to place the child's shoe in its proper position within the liner before the child's foot is slipped into the boot. The parent is thus assured that the shoe is properly in place within the overshoe. Because of the overshoe's light weight and snug-fitting closures, the overshoe is much less likely to slip off or to permit the child's shoe from slipping off his foot. In addition, when the overshoe is removed from the shoe, the shoe remains intact on the child's foot. The loose-fitting design of the outer boot and the expandable, snug-fitting sock-like liner provide an overshoe which can be worn over a range of shoe sizes. Therefore, one size overshoe will fit a growing child for several seasons and need not be replaced each time the child's shoe size increases.

The overshoe of the present invention can also function as a boot to be worn over a socked foot and still provides sufficient warmth and dryness. Thus, the present invention provides a dual use: that of covering a shoed or unshoed foot. Besides affording greater versatility of use, the overshoe thus also can provide an extra season of wear after the boot no longer fits over the child's shoe.

In addition to providing an improvement over conventional overshoes, the overshoe of the present invention affords an alternative to the conventional boot that fits over the wearer's unshoed foot. The conventional boot usually falls off the foot due to the weight of the boot and the insufficiency or lack of fastening means to provide an adequate fit. The present invention overcomes these problems and provides an overshoe with many unique advantages, especially for wear by small children, as will become apparent from the detailed description below.

BRIEF DESCRIPTION OF THE DRAWINGS

Other objects, features and advantages will appear from the following description of a preferred embodiment of the invention as shown in the accompanying drawings, in which.

DETAILED DESCRIPTION OF THE PREFERRED EMBODIMENT

Figure 1:
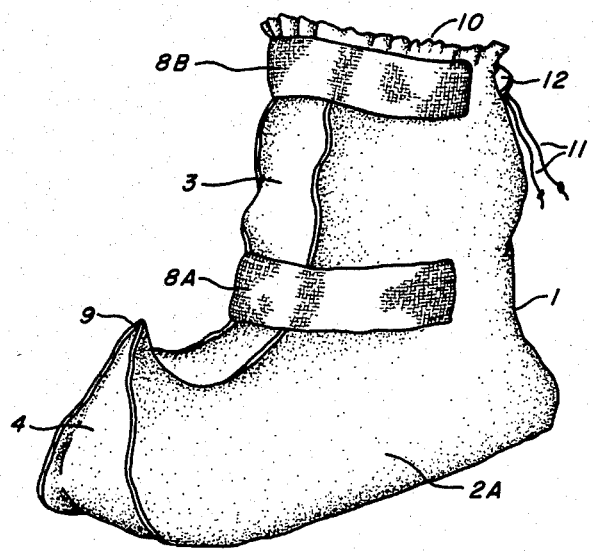
FIG. 1 is a side perspective view of the overshoe of the present invention.
Figure 2:
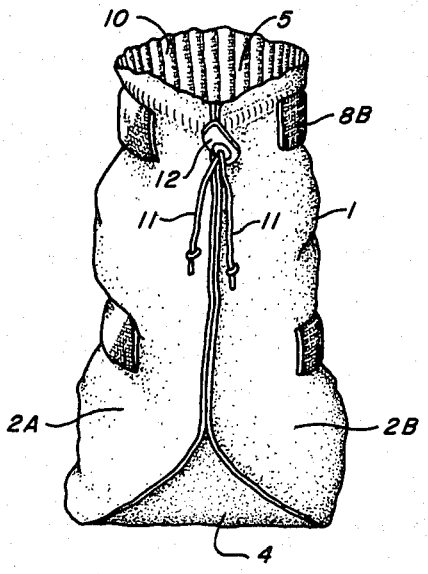
FIG. 2 is a rear perspective view of the overshoe of the present invention.

Referring in detail to the drawings, FIGS. 1 and 2 illustrate an overshoe having an outer boot 1 comprised of side panels 2A and 2B, top panel 3, and bottom panel 4. Side panels 2A and 2B are sewn together along the back, as shown in FIG. 2. Bottom panel 4 and top panel 3 are sewn between side panels 2A and 2B along their bottom and top edges, respectively. All four panels meet at a point 9 above the toe portion of the boot. Side panels 2A and 2B and top panel 3 form the top opening 10 of the overshoe.

Outer boot 1 is formed of a flexible material which is preferably lightweight and waterproof. Material such as nylon combined with a waterproof material are preferable.

Figure 3:
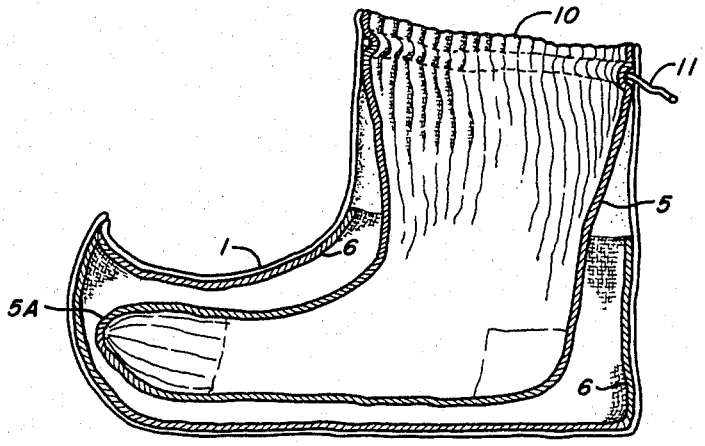
FIG. 3 is a side view in partial cross-section showing various components of the overshoe of the present invention.
Figure 5:
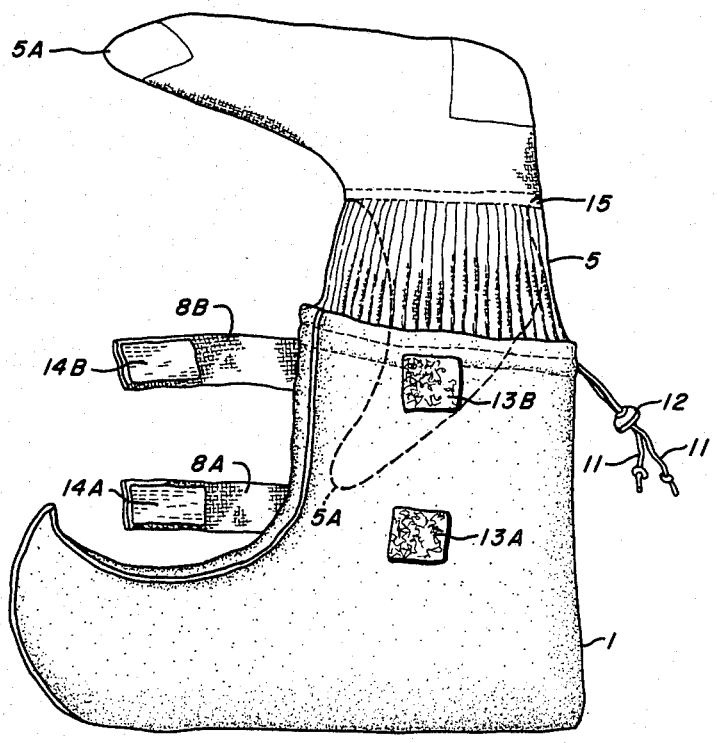
FIG. 5 is a side view of the overshoe of the present invention with the sock-like liner pulled out of the boot and shown in phantom in its folded configuration ready to accept the wearer's shoe.

Referring to FIGS. 3 and 5, a sock-like liner 5 is provided which is attached to the outer boot along the circumference of the top opening 10. The toe end 5A of the sock-like liner 5 is closed. The sock-like liner 5 may be pulled completely outside the outer boot, as shown in FIG. 5. A fold-line or seam 15 is provided in sock-like liner 5 just below the portion corresponding to the heel of the shoe to be placed inside. In order to put on the overshoe, the sock-like liner is pulled out to its fully extended position; then the sock-like liner 5 is folded along line 15, so that the toe portion 5A is pushed in to form a pocket for the shoe. The wearer's shoe is placed in the pocket so formed and once in place, is slipped inside the outer boot, pulling the sock-like liner 5 back in place inside the boot.

When empty, the sock-like liner 5 is substantially smaller than outer boot 1; when the wearer's shoe is introduced, the sock-like liner 5 stretches to fit snugly over the shoe.

Sock-like liner 5 is preferably formed of a knitted expandable fabric or other stretchable material, preferable of a "breathable" thermally insulating material which allows perspiration to evaporate. Synthetic fabrics or wool blends are suitable materials.

Lower strap 8A and upper strap 8B are provided at points below and above the wearer's ankle, respectively, in order to afford a snug fit at these points to the loose-fitting outer boot 1 and to keep the top of the overshoe from slipping down. Closing means for straps 8A and 8B are provided. Such closing means may be in the form of buckles or other means, but are preferably VELCRO self-adhering fabric closures 13A and 14A, 13B and 14B, as shown in FIG. 5. A drawstring 11 is provided inside the outer boot so that the top opening 10 may be drawn closed to a snug fit around the wearer's leg, in order to provide an adjustable means for snuggly fitting the top opening 10. The overshoe may be pulled over the wearer's lower pant leg before the drawstring 11 is closed. A toggle 12 or other means is provided in order to keep the drawstring 11 closed. The overshoe may further be provided with elastic banding (not shown) affixed inside the outer boot as an additional or alternative means of providing an expandable yet snug fit to the top opening 10.

An additional lining 6 is affixed inside outer boot 1 between the sock-like liner 5 and the outer boot 1. The additional lining 6 should at least partially line outer boot 1, and preferably should line the entire lower portion of outer boot 1 up to the area corresponding to lower strap 8A. The additional lining 6 gives reinforcement to the shape of outer boot 1 and provides additional insulation. The additional lining 6 is preferably of a flexible material which absorbs perspiration, such as wool interfaced with nylon.

Figure 4:
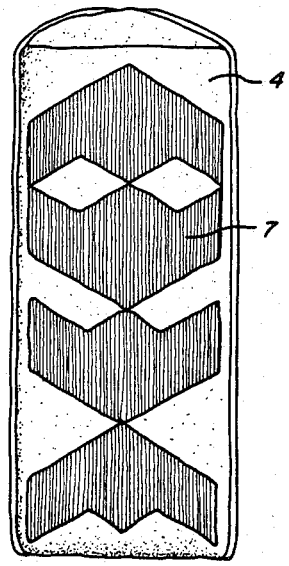
FIG. 4 is a bottom view of the overshoe of the present invention.

Referring to FIG. 4, lower panel 4 is provided with a sole portion 7 comprising one or more pieces of lightweight material for providing friction to the bottom of the overshoe. Such material is preferably flexible and can be of leather, rubber, crepe, or any other suitable natural or synthetic material. The sole portion 7 may be shaped in a geometric pattern which provides a distinctive imprint in the snow.

The design of the toe portion of the outer boot 1 wherein the panels join to form a point 9 above the wearer's toe affords a shape which has flexibility to accommodate shoes of varying size and shape. The loose fitting design of the outer boot 1 combined with the snug-fitting, stretchable sock-like liner 5 provides an overshoe which is warm, comfortable and versatile for wear over various shoe sizes. The design of sock-like liner 5 further provides a means for assuring proper positioning of the wearer's shoe in the overshoe, a feature which is highly desirable for children's overshoes.

Modifications and adaptations of the construction of the overshoe of the invention may occur to one skilled in the art without departing from the spirit of the present invention.

What is claimed is:

1. An overshoe comprising:

a loose-fitting outer boot for receiving the shoe of a wearer, having a sole portion, two side portions, and a foot-receiving opening, said side portions extending at least above the ankle of the wearer, a sock-like liner of expandable fabric, one end of said sock-like liner being affixed to said outer boot at said foot-receiving opening, the other end of said sock-like liner being closed, said sock-like liner being substantially smaller in size than said outer boot, such that when the wearer's shoe is introduced, the sock-like liner stretches to fit snugly over the shoe, said sock-like liner, when pulled out of said outer boot, being capable of receiving the wearer's shoe before placement of the shoe into said outer boot through said foot-receiving opening, and means for securing said overshoe snugly at said foot-receiving opening, and means for securing said overshoe snugly at said ankle.

2. An overshoe as in claim 1, wherein said outer boot is of a lightweight flexible material.

3. An overshoe as in claim 1, further comprising a second lining, said second lining at least partially lining the inside of said outer boot.

4. An overshoe as in claim 3, wherein said second lining is of a thermally insulating material.

5. An overshoe as in claim 3, wherein said second lining is of a moisture absorbent material.

6. An overshoe as in claim 1, wherein said means for securing said overshoe at said ankle comprises at least one strap having first and second ends, said first end affixed at one of said side portions, said second end being releaseably affixed to said other side portion.

7. An overshoe as in claim 1, wherein said sock-like liner is of a knitted material.

8. An overshoe as in claim 1, wherein said outer boot is of a water-repellent material.

9. An overshoe as in claim 1, wherein said sock-like liner comprises a fold-line circumscribing the sock-like liner at a distance from the closed end of said liner corresponding to approximately the length of a shoe to be received.

10. An overshoe as in claim 1, wherein said sock-like liner is of a thermally insulating material.

11. An overshoe as in claim 1, wherein said means for securing said overshoe at said foot-receiving opening comprises at least one strap having first and second ends, said first end affixed at one of said side portions, said second end being releaseably affixed to said other side portion.

12. An overshoe as in claim 1 or 11, further comprising a drawstring affixed within said overshoe adjacent said foot-receiving opening.

13. An overshoe as in claim 1, said outer boot further comprising an upper portion adjacent each of said side portions.

14. An overshoe as in claim 1 or 13, wherein said sole, side, and upper portions of said outer boot converge to a pointed toe extending in an upward direction.

15. An overshoe as in claim 1, wherein said sole portion of said outer boot comprises a lightweight material which affords traction to the overshoe.

16. An overshoe as in claim 15, wherein said material is from the group consisting of leather, rubber and crepe.

17. An overshoe as in claim 15, wherein said material is affixed to said sole portion in pieces arrayed to form a pattern on said sole portion.

* * * * *